US010924841B2

(12) United States Patent
Guo et al.

(10) Patent No.: US 10,924,841 B2
(45) Date of Patent: Feb. 16, 2021

(54) BLUETOOTH SPORT EARPHONE

(71) Applicant: SHENZHEN GRANDSUN ELECTRONIC CO., LTD., Shenzhen (CN)

(72) Inventors: Shiwen Guo, Shenzhen (CN); Haiquan Wu, Shenzhen (CN); Yuanfa Xin, Shenzhen (CN); Xin Yu, Shenzhen (CN); Ruiwen Shi, Shenzhen (CN)

(73) Assignee: SHENZHEN GRANDSUN ELECTRONIC CO., LTD., Shenzhen (CN)

( * ) Notice: Subject to any disclaimer, the term of this patent is extended or adjusted under 35 U.S.C. 154(b) by 0 days.

(21) Appl. No.: 16/499,329

(22) PCT Filed: Jun. 20, 2017

(86) PCT No.: PCT/CN2017/089115
§ 371 (c)(1),
(2) Date: Sep. 30, 2019

(87) PCT Pub. No.: WO2018/205356
PCT Pub. Date: Nov. 15, 2018

(65) Prior Publication Data

US 2020/0068288 A1 Feb. 27, 2020

(30) Foreign Application Priority Data

May 10, 2017 (CN) ..... 201720516843.6
May 12, 2017 (CN) ..... 201710338659.1
May 12, 2017 (CN) ..... 201720538477.4

(51) Int. Cl.
*H04R 1/10* (2006.01)
*H01Q 1/46* (2006.01)

(52) U.S. Cl.
CPC ..... *H04R 1/1041* (2013.01); *H01Q 1/46* (2013.01); *H04R 1/1016* (2013.01);
(Continued)

(58) Field of Classification Search
CPC .... H04R 1/105; H04R 1/1016; H04R 1/1041; H04R 1/1066; H04R 2420/07;
(Continued)

(56) References Cited

U.S. PATENT DOCUMENTS 9,215,536 B2 * 12/2015 Lu ..... H04R 25/554
9,445,175 B2 * 9/2016 Seo ..... H04R 5/033
(Continued)

FOREIGN PATENT DOCUMENTS

CN 205830031 * 12/2016 ..... H04R 25/00

*Primary Examiner* — Lun-See Lao
(74) *Attorney, Agent, or Firm* — Robert L. Stearns; Dickinson Wright PLLC

(57) ABSTRACT

A Bluetooth sport earphone, including a left earphone and a right earphone and a controller. The controller comprises a casing, a main control circuit board, a battery and a Bluetooth module, the Bluetooth earphone further includes a left wire, a right wire and a cable antenna electrically connected to the main control circuit board; the cable antenna is mounted on at least one of the casing, the left wire and the right wire. The present application provides a cable antenna, and the cable antenna is mounted in the casing, or/and the left wire, or/and the right wire, which can facilitate the arrangement of the cable antenna and determine the size, length and arrangement position of the antenna, such that the stability and intensity of the signal transmitting is improved, and the signal intensity of the wireless communication of the Bluetooth earphone is improved, and the communication stability is ensured.

18 Claims, 7 Drawing Sheets

(52) U.S. Cl.
CPC ..... *H04R 1/1025* (2013.01); *H04R 1/1033* (2013.01); *H04R 2420/07* (2013.01)

(58) Field of Classification Search
CPC ..... H04R 1/1008; H04R 1/10; H04R 1/1025; H04R 1/1033; H04R 1/1058; H04R 2201/107; H04R 25/606; H04R 5/023; H04L 67/125; H04M 1/72533; H04N 1/00307; H04N 2201/0055; H04N 2201/0075; H04N 2201/0084; H04N 5/23203; H04N 5/23206; H04N 5/23216; H04N 5/23258; H04W 4/00; H04W 4/80; H04W 8/22
USPC ..... 381/300, 322, 309, 150, 1–3, 180, 370, 381/371, 324, 312, 384; 455/73, 550.1, 455/575.1–575.3
See application file for complete search history.

(56) References Cited

U.S. PATENT DOCUMENTS

2011/0170702 A1* 7/2011 Bays ..... H04R 5/0335 381/74
2016/0381453 A1* 12/2016 Ushakov ..... H04R 1/1066 381/71.6
2018/0309515 A1* 10/2018 Murakowski ..... H04B 10/69

* cited by examiner

BLUETOOTH SPORT EARPHONE

CROSS-REFERENCE TO RELATED APPLICATION

This application is a 35 U.S.C. § 371 national stage application of PCT Application Serial No. PCT/CN2017/089115 filed on Jun. 20, 2017, which claims priority to Chinese Patent Application Ser. Nos. CN201720516843.6, filed on May 10, 2017, CN201710338659.1, filed on May 12, 2017, and CN201720538477.4, filed on May 12, 2017, each of which are hereby incorporated by reference in their entireties.

TECHNICAL FIELD

The present application relates to the earphone field, and more particularly to a Bluetooth earphone.

BACKGROUND TECHNOLOGY

A Bluetooth earphone generally includes two earphones each having a sound generation unit, controller and wires electrically connected the two earphones to the controller, respectively; the controller is provided with a battery, a main control circuit board and a Bluetooth module. In order to improve the stability and intensity of signal transmitting, the main control circuit board is generally provided with an antenna. However, due to the limitation of the main control circuit board, the antennas are disposed in a smaller size, currently, which resulting in a weaker communication signal of the Bluetooth earphone.

SUMMARY

An object of the present application is to provide a Bluetooth earphone, in order to solve the problem that the communication signal of the Bluetooth earphone is weaker in the prior art.

In order to achieve the above object, the present application adopts the technical solution is to provide a Bluetooth earphone, including:

a left earphone and a right earphone, each provided with a sound generation unit;

a controller, configured to control the left earphone and the right earphone, the controller including a casing, a main control circuit board disposed in the casing, a battery mounted inside the casing and a Bluetooth module configured for wireless communication; the battery and the Bluetooth module being respectively electrically connected to the main control circuit board, the Bluetooth earphone further comprising:

a left wire, configured to electrically connect the left earphone to the main control circuit board; and a right wire, configured to electrically connect the right earphone to the main control circuit board;

the Bluetooth earphone further includes a cable antenna electrically connected with the main control circuit board, and at least one of the casing, the left wire, and the right wire is mounted with the cable antenna.

Further, the cable antenna includes:

a conductive inner core;

a conductive outer layer; and an insulating layer, disposed between the conductive inner core and the conductive outer layer;

wherein the conductive inner core is electrically connected to the main control circuit board.

Further, an end of the cable antenna is provided with a signal transmitting and receiving end; the signal transmitting and receiving end includes: a conductive segment and an insulating segment; wherein the conductive segment is a segment of the conductive inner core extending out of an end of the conductive outer layer, and the insulating segment is a segment of the insulating layer extending out of an end of the conductive outer layer; wherein a length of the signal transmitting and receiving end is one quarter of a wavelength of a transmitted and received signal.

Further, the conductive outer layer is a shielding layer sleeved on the insulating layer.

Further, the cable antenna further includes a protective outer layer sleeved on the conductive outer layer, and the conductive outer layer is disposed between the insulating layer and the protective outer layer.

Further, the casing is an unclosed elastic collar having two ends, and the main control circuit board, the battery and the Bluetooth module are disposed at the middle of the casing.

Further, the left wire and the right wire are respectively extended from the two ends of the casing.

Further, the cable antenna is electrically connected to the main control circuit board through a corresponding end of the casing extending into the casing.

Further, the cable antenna and the left wire or the right wire form a multi-core cable.

Further, the cable antenna on the left wire is spaced apart from the left wire, and/or the cable antenna on the right wire is spaced apart from the right wire.

Further, the casing includes: a middle control box, a left arm and a right arm respectively extending from two ends of the middle control box, a left control box connected to a free end of the left arm, and a right control box connected to a free end of the right arm.

Further, the cable antenna is mounted inside the casing, and the cable antenna is extending in a direction away from the main circuit board to the left arm, the right arm, the left control box, or the right control box.

Further, a left control circuit board and the cable antenna are mounted inside the left control box, and the left control circuit board is electrically connected to the main control circuit board, the cable antenna is arranged around the left control circuit board and configured to be spaced apart from the left control circuit board.

Further, the left control circuit board is provided with a first antenna electrically connected with the cable antenna.

Further, the first antenna is a printed antenna or a ceramic antenna.

Further, a first flexible flat conductive wire is extended from the left control circuit board, and the first flexible flat conductive wire is provided with a conductive layer electrically connected with a ground layer of the left control circuit board.

Further, a right control circuit board and the cable antenna are mounted inside the right control box, and the right control circuit board is electrically connected to the main control circuit board, the cable antenna is arranged around the right control circuit board and configured to be spaced apart from the right control circuit board.

Further, the right control circuit board is provided with a second antenna electrically connected with the cable antenna.

Further, the second antenna is a printed antenna or a ceramic antenna.

Further, a second flexible flat conductive wire is extended from the right control circuit board, and the second flexible flat conductive wire is provided with a conductive layer electrically connected with a ground layer of the right control circuit board.

The beneficial effects of the Bluetooth earphone provided by the present application are as follows: compared with the prior art, the present application provides a cable antenna, and the cable antenna is mounted in the casing, or/and the left wire, or/and the right wire, which can facilitate the arrangement of the cable antenna and determine the size, length and arrangement position of the antenna, such that the stability and intensity of the signal transmitting is improved, and the signal intensity of the wireless communication of the Bluetooth earphone is improved, and the communication stability is ensured.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

FIG. 12 is a structural schematic view of a Bluetooth earphone according to a second embodiment of the present application;

Figure 1:
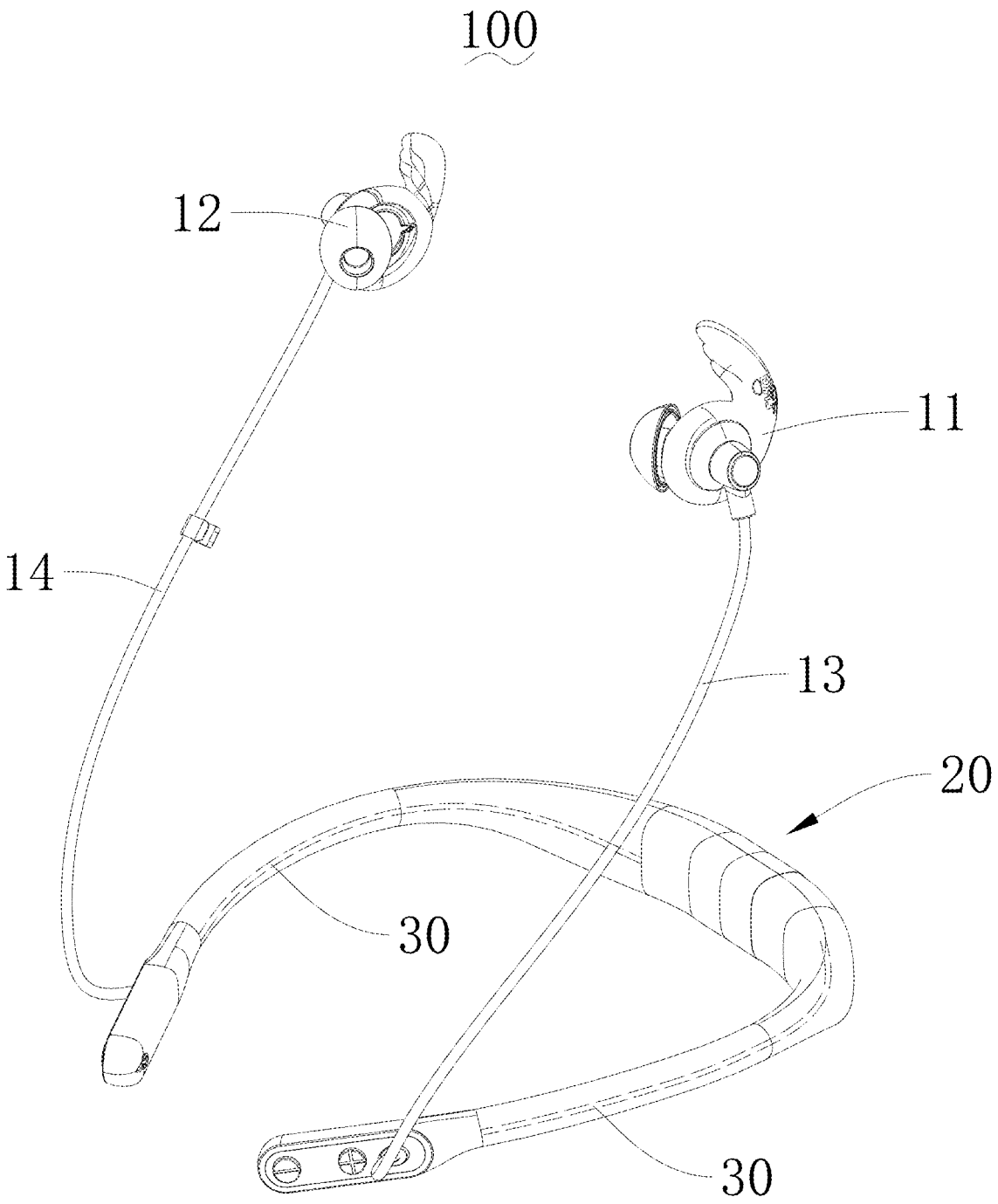
FIG. 1 is a structural schematic view of a Bluetooth earphone according to an embodiment one of the present application.

In the drawings, the numerals refer to the components are listed:

100—Bluetooth earphone; 11—left earphone; 12—right earphone; 13—left wire; 14—right wire; 20—controller; 21—casing; 211—middle control box; 212—left arm; 213—right arm; 214—left control box; 215—right control box; 22—main control circuit board; 23—battery; 30—cable antenna; 31—conductive inner core; 32—insulating layer; 33—conductive outer layer; 34—protective outer layer; 35—conductive wire; 41—right control circuit board; 42—left control circuit board; 43—right control button; 44—left control button; 46—flexible circuit board.

DETAILED DESCRIPTION

In order to make the purpose, the technical solution and the advantages of the present application be clearer and more understandable, the present application will be further described in detail below with reference to accompanying figures and embodiments. It should be understood that the specific embodiments described herein are merely intended to illustrate but not to limit the present application.

It is noted that when a component is referred to as being "fixed to" or "disposed on" another component, it can be directly or indirectly on another component. When a component is referred to as being "connected to" another component, it can be directly or indirectly connected to another component. Terms such as "mount", "connect with each other", "connect", "fix", and so on should be generalized interpreted, for example, "connect" can be interpreted as being fixedly connected, detachably connected, or connected integrally; "connect" can also be interpreted as being mechanically connected or electrically connected; "connect" can be further interpreted as being directly connected or indirectly connected through intermediary, or being internal communication between two components or an interaction relationship between the two components. For the one of ordinary skill in the art, the specific meanings of the aforementioned terms in the present application can be interpreted according to specific conditions.

It should be noted that, positional terms in the following embodiments, such as "left", "right", "up", "down", "top", "bottom", and so on, are merely mutually relative concepts or take a normal use state of a product as a reference, and shouldn't be considered as being restrictive.

First Embodiment

Please refer to FIGS. 1-5, the Bluetooth earphone 100 provided by the present application is described herein. The Bluetooth earphone 100 includes a left earphone 11, a right earphone 12, a controller 20, a left wire 13, a right wire 14 and a cable antenna 30; the left earphone 11 is provided with a sound generation unit configured to facilitate producing a sound; the right earphone 12 is also provided with a sound generation unit configured to facilitate producing a sound. The left wire 13 is electrically connected to the left earphone 11 and the controller 20, and the right wire 14 is electrically connected to the right earphone 12 and the controller 20 to control the left earphone 11 and the right earphone 12 to produce a sound through the controller 20. The controller 20 includes a casing 21, a main control circuit board 22, a battery 24 and a Bluetooth module; the main control circuit board 22 is mounted in the casing 21, and the left wire 13 and the right wire 14 are respectively connected to the main control circuit board 22, such that the left earphone 11 and the right earphone 12 are respectively controlled by the main control circuit board 22 through the left wire 13 and the right wire 14 to produce sound; the battery 24 is mounted in the casing 21, and the battery 24 is electrically connected to the main control circuit board 22 for power supply; the Bluetooth module is electrically connected to the main control circuit board 22 for wireless communication, such as achieving the wireless communication through the Bluetooth module and a smart phone and the like; the cable antenna 30 is electrically connected to the main control circuit board 22 to enhance the signal transmitting and receiving performance of the Bluetooth module to improve the stability and intensity of the signal transmission; while the cable antenna 30 is used, which can facilitate the position layout and the arrangement of the shape of the antenna, and further facilitate the arrangement and selection of the length and the size of the antenna. In the present embodiment, the cable antenna 30 is disposed in the casing 21 for the mounting and positioning of the cable antenna 30.

Compared with the prior art, the Bluetooth earphone 100 provided by the present application, the present application is provided with the cable antenna 30, the cost is low; the cable antenna 30 is disposed in the casing 21, which is facilitated for mounting and fixing the cable antenna 30 and determining the mounting position of the cable antenna 30, and further can facilitate the arrangement of the cable antenna 30 and determine the size, length and arrangement position of the antenna, such that the stability and intensity of the signal transmitting is improved, and the signal intensity of the wireless communication of the Bluetooth earphone 100 is improved, and the communication stability is ensured.

In addition, in other embodiments, the cable antenna 30 can be mounted on the left wire 13 or/and the right wire 14.

Figure 2:
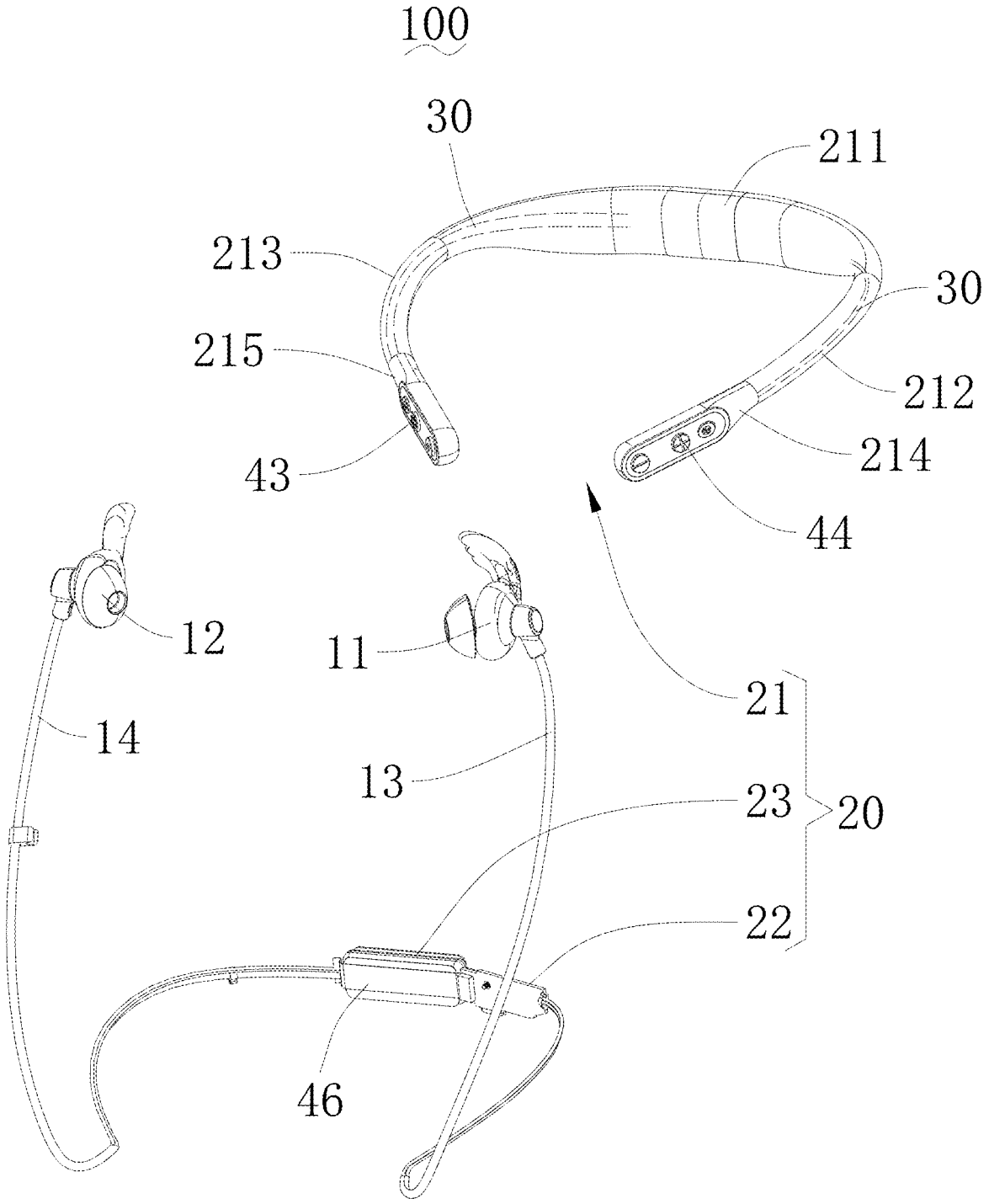
FIG. 2 is a schematic view of explosion structure of a Bluetooth earphone according to a first embodiment of the present application.
Figure 3:
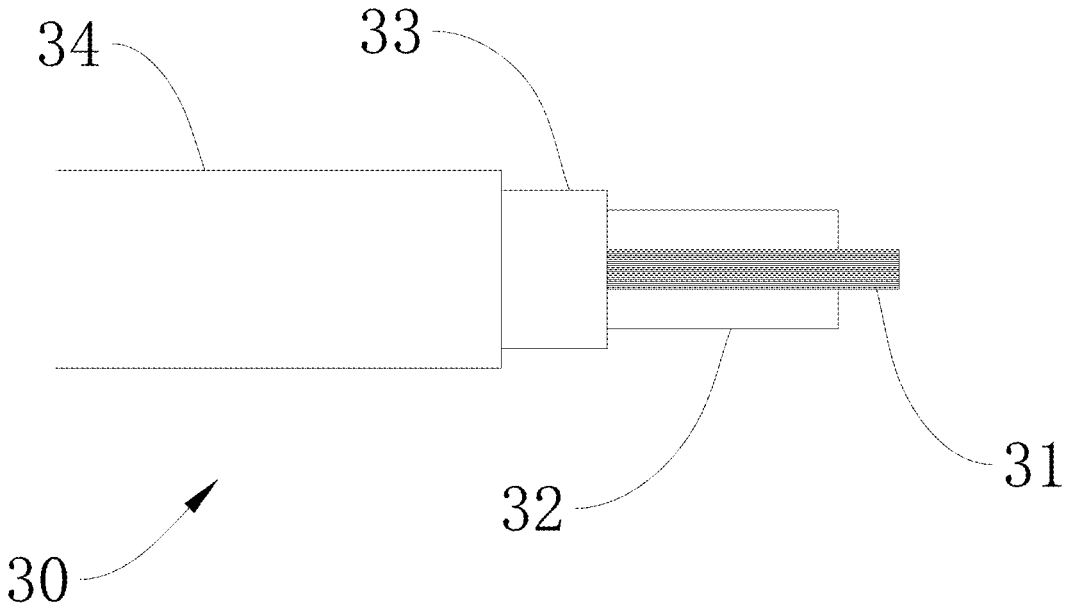
FIG. 3 is a structural schematic view of a cable antenna of FIG. 2.

Further, please refer to FIGS. 1 to 3 together. As a specific implementation manner of the Bluetooth earphone 100 provided by the present application, the cable antenna 30 includes a conductive inner core 31, a conductive outer layer 33, and an insulating layer 32. The conductive inner core 31 is electrically connected to the main circuit board 22, and the conductive outer layer 33 is electrically connected to the main control circuit board 22 to be grounded for shielding, that is, the cable antenna 30 is electrically connected to the main control circuit board 22, and then electrically connected to the Bluetooth module. The insulating layer 32 is disposed between the conductive inner core 31 and the conductive outer layer 33, and the insulating layer 32 is sleeved on the conductive inner core 31. The conductive inner core 31 and the conductive outer layer 33 are respectively electrically connected to the main control circuit board 22 to act as two poles of the antenna; and the insulating layer 32 is disposed between the conductive inner core 31 and the conductive outer layer 33, which can isolate the conductive inner core 31 from the conductive outer layer 33 to prevent the conductive inner core 31 from being short-circuited with the conductive outer layer 33. The insulating layer 32 is sleeved on the conductive inner core 31 to protect the conductive inner core 31. In addition, in other embodiments, a wire having an enameled wire may be used as the antenna, and any two of the wires may be used as the two poles of the antenna. In still other embodiments, a twisted pair cable can also be used as the cable antenna 30.

Further, as a specific implementation manner of the Bluetooth earphone 100 provided by the present application, the conductive outer layer 33 is a shielding layer sleeved on the insulating layer 32. This structure can use a wire having a shield as a wire antenna.

Further, as a specific implementation manner of the Bluetooth earphone 100 provided by the present application, an end of the cable antenna 30 is provided with a signal transmitting and receiving end, and the signal transmitting and receiving end includes a conductive segment and an insulating segment, the conductive segment is a segment of the conductive inner core 31 extending out of an end of the conductive outer layer 33, and the insulating segment is a segment of the insulating layer 32 extending out of an end of the conductive outer layer 33; and a length of the signal transmitting and receiving end is one quarter of a wavelength of the transmitted and received signal. That is, a segment of the end of the conductive core 31 that extends from the end of the conductive outer layer 33 is the above-mentioned conductive segment, and a segment of the end of the insulating layer 32 that extends from the end of the conductive outer layer 33 is the above-mentioned insulating segment, the above-mentioned conductive segment and the above-mentioned insulating segment are formed the above-mentioned signal transmitting and receiving end to receive and transmit signals more stably, and the insulating segment can function to protect the conductive segment. In still other embodiments, if the conductive inner core 31 uses a hard metal wire, a segment of the end of the conductive inner core 31 that extends from the end of the conductive outer layer 33 can be directly used as the signal transmitting and receiving end.

Further, as a specific implementation manner of the Bluetooth earphone 100 provided by the present application, the cable antenna 30 further includes a protective outer layer 34 sleeved on the insulating layer 32, and the conductive outer layer 33 is disposed between the insulating layer 32 and the protective outer layer 34. The disposing of the protective outer layer 34 can serve to protect the conductive outer layer 33. The structure can process the conductive outer layer 33 on the insulating layer 32 and then sleeve on the conductive outer layer 33 through the protective outer layer 34. The protective outer layer 34 can be made of an insulating material to serve insulation and protection. In addition, when the cable antenna 30 is a coaxial conductive wire, the conductive outer layer 33 is a shielding layer of the coaxial conductive wire, and the conductive inner core 31 is the inner core of the coaxial conductive wire.

Further, as a specific implementation manner of the Bluetooth earphone 100 provided by the present application, the casing 21 is an unclosed elastic collar having two ends, such that the controller 20 is a neck collar structure; the main control circuit board 22 and the battery 23, the Bluetooth module are disposed in the middle of the casing 21. Using the neck collar structure as the controller 20, it can be worn on the neck of the user. The casing 21 is arranged in an arc shape, which is convenient for wearing. In addition, in other embodiments, the controller 20 can also have an elongated structure.

Further, as a specific implementation manner of the Bluetooth earphone 100 provided by the present application, the left wire 13 and the right wire 14 are respectively extended from two ends of the casing 21, which facilitates for distinguishing between left and right, it is convenient for mounting, and it is also convenient for processing. In addition, in other embodiments, the left wire 13 and the right wire 14 may also extend from the middle of the neck collar.

Figure 4:
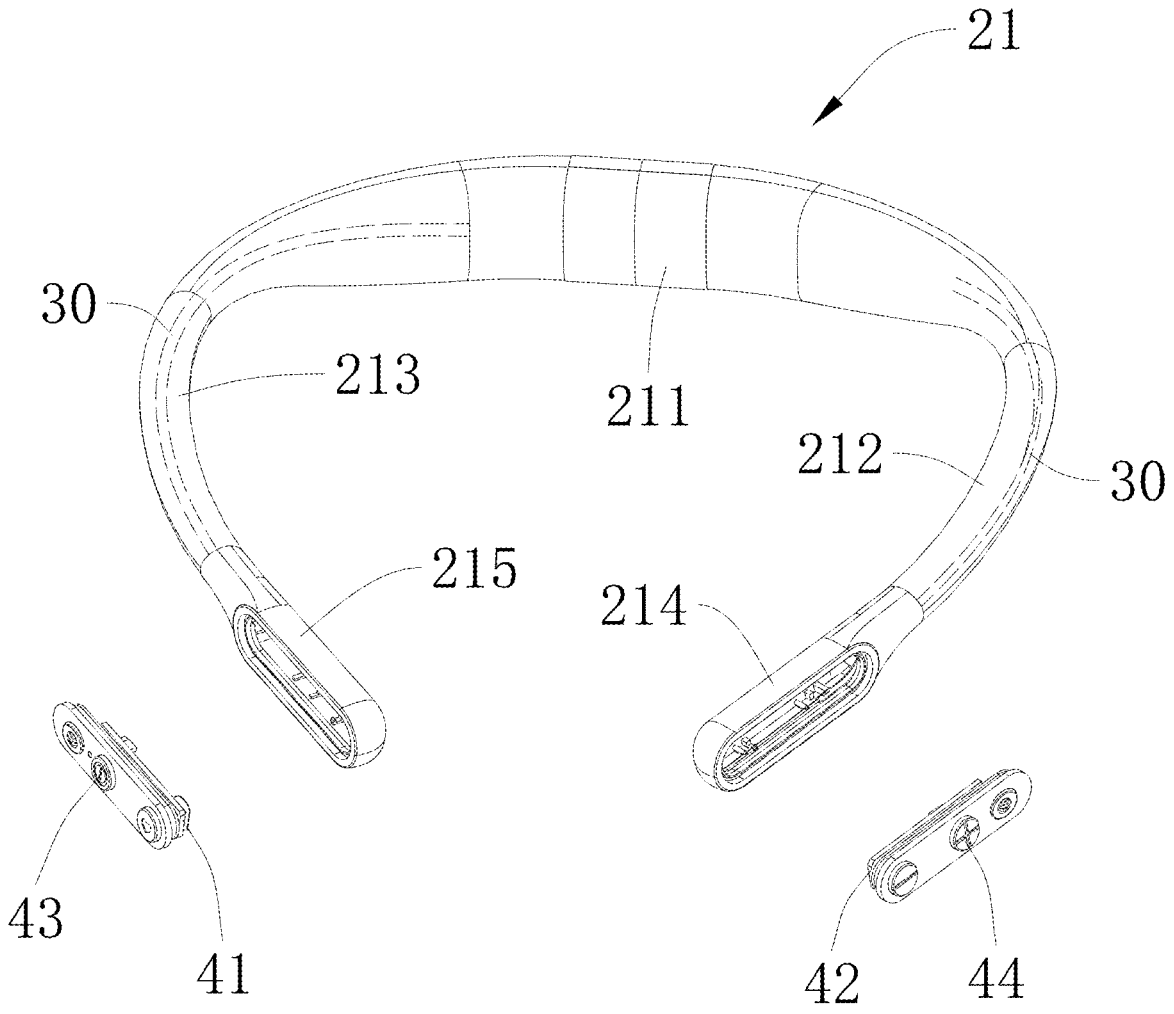
FIG. 4 is a first schematic view of explosion structure of a casing, a left control circuit board and a right control circuit board of FIG. 2.
Figure 5:
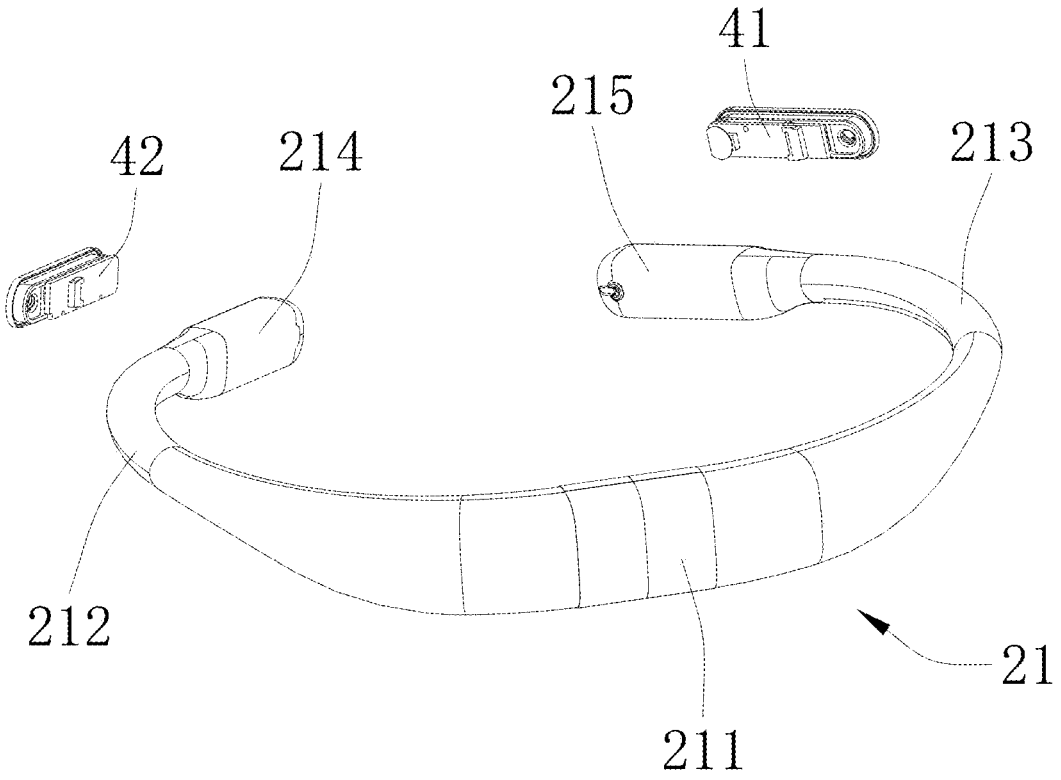
FIG. 5 is a second schematic view of explosion structure of a casing, a left control circuit board and a right control circuit board of FIG. 4.

Further, please refer to FIG. 2, FIG. 4 and FIG. 5, as a specific implementation manner of the Bluetooth earphone 100 provided by the present application, the casing 21 includes a middle control box 211, a left arm 212, a right arm 213, and a left control box 214 and right control box 215.

The left arm 212 and the right arm 213 are respectively extended from the two ends of the middle control box 211, that is, the left arm 212 is connected to the left end of the middle control box 211, and the right arm 213 is connected to the right end of the middle control box 211, and the left control box 214 is connected to the free end of the left arm 212 and the right control box 215 is connected to the free end of the right arm 213. The casing 21 is provided as a middle control box 211, a left arm 212, a right arm 213, a left control box 214, and a right control box 215 to facilitate processing and to facilitate the arrangement and mounting of various components in the controller 20.

Further, the battery 24 is mounted in the middle control box 211, the main control circuit board 22 is mounted in the middle control box 211, and the Bluetooth module is mounted in the middle control box 211. The cable antenna 30 is mounted in one or more of the left arm 212, the right arm 213, the left control box 214, and the right control box 215.

Further, as a specific implementation manner of the Bluetooth earphone 100 provided by the present application, at least one of the middle control box 211, the left arm 212, the right arm 213, the left control box 214, and the right control box 215 is mounted with a cable antenna 30. Since the neck collar structure is relatively large, the cable antenna 30 is mounted in any of the middle control box 211, the left arm 212, the right arm 213, the left control box 214, and the right control box 215, and a larger antenna structure can be disposed to improve the stability of the Bluetooth signal.

Further, as a specific implementation manner of the Bluetooth earphone 100 provided by the present application, when the cable antenna 30 is mounted in the casing 21, the cable antenna 30 extends away from the main control circuit board 22 to the middle control box 211, the left arm 212, the right arm 213, the left control box 214 or the right control box 215. Thereby, it is convenient to arrange the cable antenna 30.

Further, in this embodiment, the cable antenna 30 is mounted in the left arm 212, and both ends of the cable antenna 30 respectively extend into the middle control box 211 and the left control box 214, to maximize the arrangement of the cable antenna 30. In other embodiments, a cable antenna 30 may also be laid out only a part in the left arm 212; or the cable antenna 30 may be laid out in the entire left arm 212; or the cable antenna 30 may be mounted in the left control box 214; or the cable antenna 30 is mounted in the middle control box 211.

Further, in this embodiment, the cable antenna 30 is mounted in the right arm 213, and both ends of the cable antenna 30 respectively extend into the middle control box 211 and the right control box 215, to maximize the arrangement of the cable antenna 30. In other embodiments, a cable antenna 30 may also be laid out only a part in the right arm 213; or the cable antenna 30 may be laid out in the entire right arm 213; or the cable antenna 30 may be mounted in the right control box 215; or the cable antenna 30 is mounted in the middle control box 211.

In addition, in other embodiments, the cable antenna 30 can be mounted and laid out in one or more of the left arm 212, the right arm 213, the left control box 214, the right control box 215, and the middle control box 211. Further, when the cable antenna 30 is laid out in one or more of the left arm 212, the right arm 213, the left control box 214, the right control box 215 and the middle control box 211, a plurality of cable antennas 30 may be arranged in any component, such as, one, two, three, etc. cable antennas 30 are arranged in the left arm 212; or one, two, three, etc. cable antennas 30 are arranged in the right arm 213.

Further, as a specific implementation manner of the Bluetooth earphone 100 provided by the present application, a left control circuit board 42 and a cable antenna 30 are mounted in the left control box 214, and the left control circuit board 42 is electrically connected to the main control circuit board 22. The cable antenna 30 is disposed around the left control circuit board 42 and is spaced apart from the left control circuit board 42. Due that the left control box 214 is small in size, the cable antenna 30 is mounted in the left control box 214, and the cable antenna 30 is disposed around the left control circuit board 42, such that the cable antenna 30 can be conveniently disposed.

Further, as a specific implementation manner of the Bluetooth earphone 100 provided by the present application, the left control circuit board 42 is provided with a first antenna (not shown) electrically connected to the cable antenna 30. The structure is provided with a first antenna on the left control circuit board 42 and can be cooperated with the cable antenna 30 to improve signal transmission stability and signal transmission intensity. Further, the cable antenna 30 can be electrically connected to the left control circuit board 42 and then electrically connected to the main control circuit board 22 via the left control circuit board 42 to facilitate connecting the cable antenna 30.

Further, as a specific implementation manner of the Bluetooth earphone 100 provided by the present application, the first antenna may be a printed antenna or a ceramic antenna, such as the first antenna is printed as produced on the left control circuit board 42. In addition, a ceramic antenna can also be produced, and then the ceramic antenna is mounted on the left control circuit board 42.

Further, as a specific implementation manner of the Bluetooth earphone 100 provided by the present application, a first flexible flat conductive wire (not shown) extends from the left control circuit board 42, and the first flexible flat conductive wire is provided with a conductive layer electrically connected to a ground layer of the left control circuit board 42. With the arrangement of the first flexible flat conductive wire, and the first flexible flat conductive wire is provided with the conductive layer therein, and then the conductive layer is electrically connected to the ground layer of the left control circuit board 42, such that the signal intensity of the cable antenna is enhanced. When the first antenna is disposed on the left control circuit board 42, the signal intensity of the first antenna can also be enhanced.

Further, as a specific implementation manner of the Bluetooth earphone 100 provided by the present application, the first flexible flat conductive wire may use a FFC (i.e., flexible flat cable) or a FPC (i.e., flexible circuit board) to facilitate wiring and electrical connection. Further, a left control button 44 is mounted on the left control circuit board 42, for example, a volume up/down button may be provided on the left control circuit board 42 to facilitate control of the Bluetooth earphone 100. Further, the left wire 13 can be connected to the left control circuit board 42 to facilitate the connection and fixing of the left wire 13.

Further, as a specific implementation manner of the Bluetooth earphone 100 provided by the present application, a right control circuit board 41 and a cable antenna 30 are mounted in the right control box 215, and the right control circuit board 41 is electrically connected to the main control circuit board 22. The cable antenna 30 is disposed around the right control circuit board 41 and is spaced apart from the right control circuit board 41. Due that the right control box 215 is small in size, the cable antenna 30 is mounted in the right control box 215, and the cable antenna 30 is disposed around the right control circuit board 41, such that the cable antenna 30 can be conveniently disposed.

Further, as a specific implementation manner of the Bluetooth earphone 100 provided by the present application, the right control circuit board 41 is provided with a second antenna (not shown) electrically connected to the cable antenna 30. The structure is provided with a second antenna on the right control circuit board 41 and can be cooperated with the cable antenna 30 to improve signal transmission stability and signal transmission intensity. Further, the cable antenna 30 can be electrically connected to the right control circuit board 41 and then electrically connected to the main control circuit board 22 via the right control circuit board 41 to facilitate connecting the cable antenna 30.

Further, as a specific implementation manner of the Bluetooth earphone 100 provided by the present application, the second antenna may be a printed antenna or a ceramic antenna, such as the second antenna is printed as produced on the right control circuit board 41. In addition, a ceramic antenna can also be produced, and then the ceramic antenna is mounted on the right control circuit board 41.

Further, as a specific implementation manner of the Bluetooth earphone 100 provided by the present application, a second flexible flat conductive wire (not shown) extends from the right control circuit board 41, and the second flexible flat conductive wire is provided with a conductive layer electrically connected to a ground layer of the right control circuit board 41. With the arrangement of the second flexible flat conductive wire, and the second flexible flat conductive wire is provided with the conductive layer therein, and then the conductive layer is electrically connected to the ground layer of the right control circuit board 41, such that the signal intensity of the cable antenna is enhanced. When the second antenna is disposed on the right control circuit board 41, the signal intensity of the second antenna can also be enhanced.

Further, as a specific implementation manner of the Bluetooth earphone 100 provided by the present application, the second flexible flat conductive wire may use a FFC (i.e., flexible flat cable) or a FPC (i.e., flexible circuit board) to facilitate wiring and electrical connection.

Further, a right control button 43 is mounted on the right control circuit board 41, for example, a volume up/down button may be provided on the right control circuit board 41 to facilitate control of the Bluetooth earphone 100. Further, the right wire 14 can be connected to the right control circuit board 41 to facilitate the connection and fixing of the right wire 14.

In addition, in other embodiments, the left control circuit board 42 and the right control circuit board 41 may be provided only one of them.

Further, as a specific implementation manner of the Bluetooth earphone 100 provided by the present application, the main control circuit board 22 is provided with a first printed antenna (not shown). The first printed antenna is disposed on the main control circuit board 22, and the first printed antenna can be cooperated with the cable antenna 30 to improve the intensity and stability of signal transmission.

Further, as a specific implementation manner of the Bluetooth earphone 100 provided by the present application, the Bluetooth earphone 100 further includes a flexible circuit board 46. The flexible circuit board 46 is electrically connected to the main control circuit board 22, and the flexible circuit board 46 is provided with a second printed antenna (not shown). The second printed antenna is disposed on the flexible circuit board 46, and the second printed antenna can be cooperated with the cable antenna 30 to improve the intensity and stability of signal transmission. At the same time, the second printed antenna is disposed on the flexible circuit board 46, which facilitates the layout and shape arrangement of the second printed antenna.

Further, as a specific implementation manner of the Bluetooth earphone 100 provided by the present application, a third printed antenna is printed on the casing, such as, the third printed antenna is printed on one or more of the left arm 212, the right arm 213, the left control box 214, and the right control box 215 to be cooperated with the cable antenna 30 to improve the intensity and stability of signal transmission.

Further, as a specific implementation manner of the Bluetooth earphone 100 provided by the present application, the cable antenna 30 may be mounted on the left wire 13 or/and the right wire 14 to facilitate the device layout of the antenna.

Further, please refer to FIG. 2 and FIG. 3 together. As a specific implementation manner of the Bluetooth earphone 100 provided by the present application, the cable antenna 30 includes a conductive inner core 31, a conductive outer layer 33, and an insulating layer 32. The conductive inner core 31 is electrically connected to the main circuit board 22, and the conductive outer layer 33 is electrically connected to the main control circuit board 22 to be grounded for shielding, that is, the cable antenna 30 is electrically connected to the main control circuit board 22, and then electrically connected to the Bluetooth module. The insulating layer 32 is disposed between the conductive inner core 31 and the conductive outer layer 33, and the insulating layer 32 is sleeved on the conductive inner core 31. The conductive inner core 31 and the conductive outer layer 33 are respectively electrically connected to the main control circuit board 22 to act as two poles of the antenna; and the insulating layer 32 is disposed between the conductive inner core 31 and the conductive outer layer 33, which can isolate the conductive inner core 31 from the conductive outer layer 33 to prevent the conductive inner core 31 from being short-circuited with the conductive outer layer 33. The insulating layer 32 is sleeved on the conductive inner core 31 to protect the conductive inner core 31. In addition, in other embodiments, a wire having an enameled wire may be used as the antenna, and any two of the wires may be used as the two poles of the antenna. In still other embodiments, a twisted pair cable can also be used as the cable antenna 30.

Further, as a specific implementation manner of the Bluetooth earphone 100 provided by the present application, the conductive outer layer 33 is a shielding layer sleeved on the insulating layer 32. This structure can use a wire having a shield as a wire antenna.

Further, as a specific implementation manner of the Bluetooth earphone 100 provided by the present application, an end of the cable antenna 30 is provided with a signal transmitting and receiving end, and the signal transmitting and receiving end includes a conductive segment and an insulating segment, the conductive segment is a segment of the conductive inner core 31 extending out of an end of the conductive outer layer 33, and the insulating segment is a segment of the insulating layer 32 extending out of an end of the conductive outer layer 33; and a length of the signal transmitting and receiving end is one quarter of a wavelength of the transmitted and received signal. That is, a segment of the end of the conductive core 31 that extends from the end of the conductive outer layer 33 is the above-mentioned conductive segment, and a segment of the end of the insulating layer 32 that extends from the end of the conductive outer layer 33 is the above-mentioned insulating segment, the above-mentioned conductive segment and the above-mentioned insulating segment are formed the above-mentioned signal transmitting and receiving end to receive and transmit signals more stably, and the insulating segment can function to protect the conductive segment. In still other embodiments, if the conductive inner core 31 uses a hard metal wire, a segment of the end of the conductive inner core 31 that extends from the end of the conductive outer layer 33 can be directly used as the signal transmitting and receiving end.

Further, as a specific implementation manner of the Bluetooth earphone 100 provided by the present application, the cable antenna 30 further includes a protective outer layer 34 sleeved on the insulating layer 32, and the conductive outer layer 33 is disposed between the insulating layer 32 and the protective outer layer 34. The disposing of the protective outer layer 34 can serve to protect the conductive outer layer 33. The structure can process the conductive outer layer 33 on the insulating layer 32 and then sleeve on the conductive outer layer 33 through the protective outer layer 34. The protective outer layer 34 can be made of an insulating material to serve insulation and protection. In addition, when the cable antenna 30 is a coaxial conductive wire, the conductive outer layer 33 is a shielding layer of the coaxial conductive wire, and the conductive inner core 31 is the inner core of the coaxial conductive wire.

Further, as a specific implementation manner of the Bluetooth earphone 100 provided by the present application, the left wire 13 and the right wire 14 are respectively extended from two ends of the casing 21, which facilitates for distinguishing between left and right, it is convenient for mounting, and it is also convenient for processing. In addition, in other embodiments, the left wire 13 and the right wire 14 may also extend from the middle of the neck collar.

Further, as a specific implementation manner of the Bluetooth earphone 100 provided by the present application, the insulating sleeve 32 is provided with a conductive wire (not shown) for electrical connection. With the arrangement of the conductive wire in the insulating sleeve 32, when the cable antennas 30 are disposed in the left arm 212, the conductive wire can be simultaneously used as electrical connecting wire to electrically connect the left control circuit board 42 with the main control circuit board 22. When the cable antenna 30 is disposed in the right arm 213, the conductive wire can be simultaneously used as an electrical connecting wire to electrically connect the right control circuit board 41 to the main control circuit board 22. In the specific production, it is necessary to insulate the conductive wire from the conductive inner core 31, such as using an enameled wire for both the conductive wire and the conductive inner core 31, or using a wire structure with an insulating skin for the conductive wire. In addition, in still other embodiments, an insulating sleeve can be provided and the conductive wire and cable antenna 30 can be integrated into the insulating sleeve.

Figure 6:
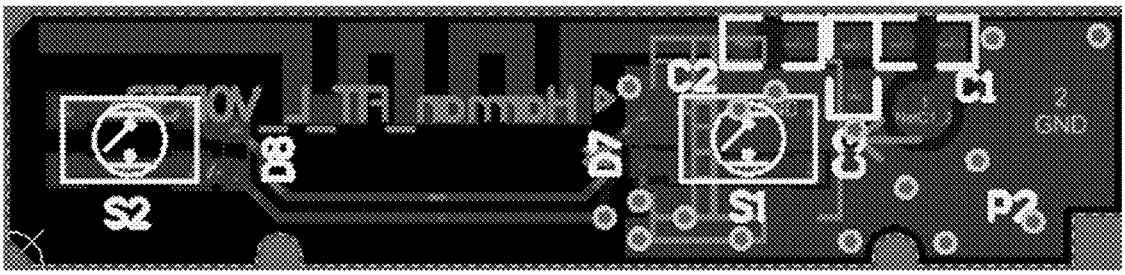
FIG. 6 is a structural schematic view of a left control circuit board provided with a printed antenna according to a first embodiment of the present application.

Further, please refer to FIG. 6. As a specific implementation manner of the Bluetooth earphone 100 provided by the present application, FIG. 6 is an antenna printed on a circuit board, and the antenna can be used as the first antenna or/and the second antenna.

Figure 7:
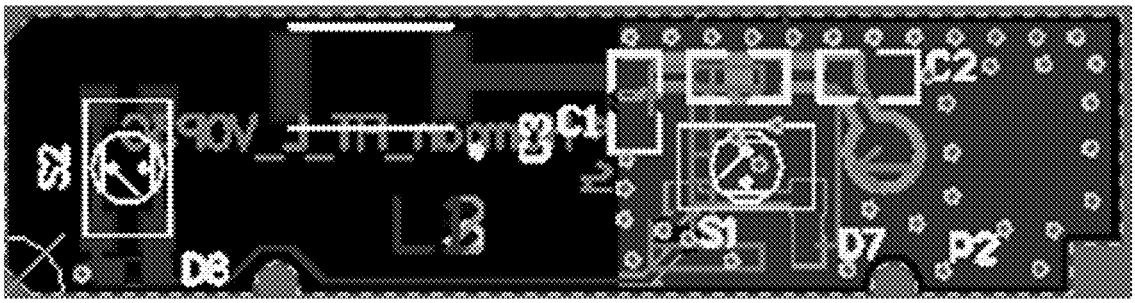
FIG. 7 is a structural schematic view of a left control circuit board provided with a ceramic antenna according to a first embodiment of the present application.

Further, please refer to FIG. 7, as a specific implementation manner of the Bluetooth earphone 100 provided by the present application, when the first antenna or/and the second antenna are ceramic antennas, the ceramic antenna structure provided in FIG. 7 may be used.

Figure 8:
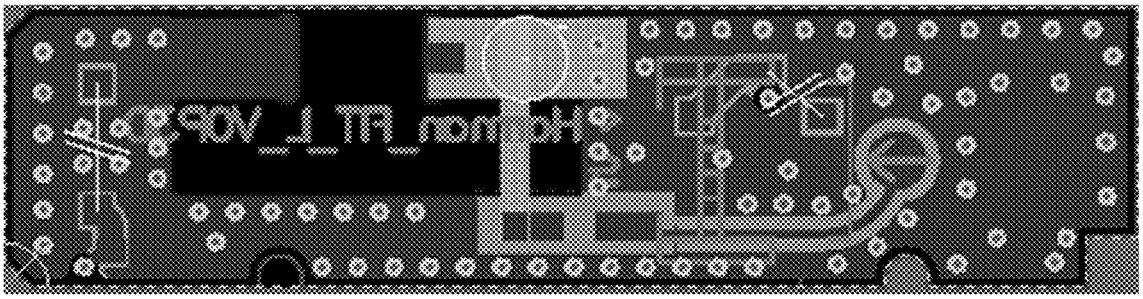
FIG. 8 is another structural schematic view of a left control circuit board provided with a ceramic antenna according to a first embodiment of the present application.

Further, please refer to FIG. 8, as a specific implementation manner of the Bluetooth earphone 100 provided by the present application, when the first antenna or/and the second antenna are ceramic antennas, the ceramic antenna structure provided in FIG. 8 may be used.

Figure 9:
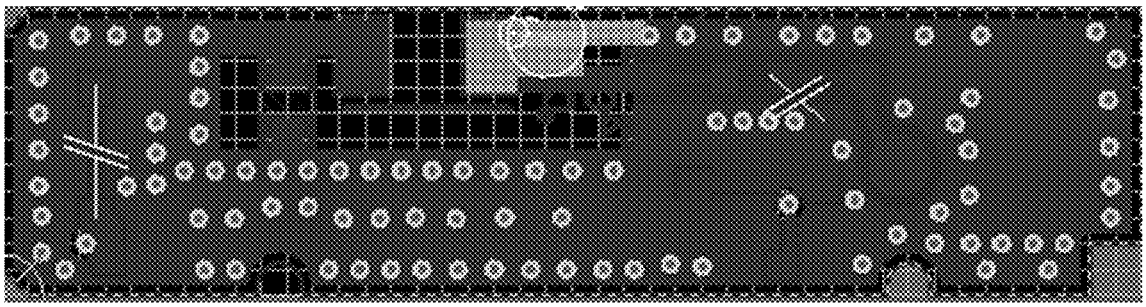
FIG. 9 is third structural schematic view of a left control circuit board provided with a ceramic antenna according to a first embodiment of the present application.

Further, please refer to FIG. 9, as a specific implementation manner of the Bluetooth earphone 100 provided by the present application, when the first antenna or/and the second antenna are ceramic antennas, the ceramic antenna structure provided in FIG. 9 may be used.

Figure 10:
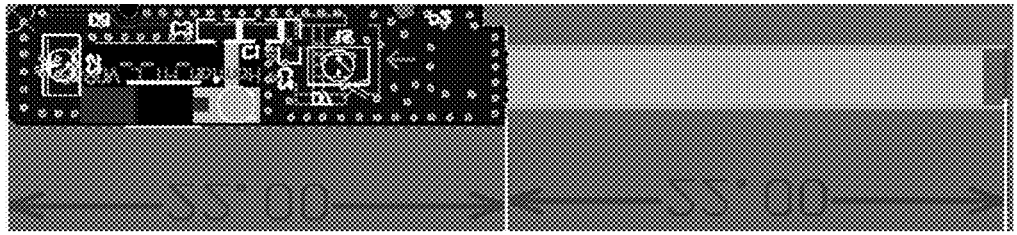
FIG. 10 is a structural schematic view of a left control circuit board connected with a first flexible circuit board according to a first embodiment of the present application.

Further, please refer to FIG. 10, as a specific implementation manner of the Bluetooth earphone 100 provided by the present application, FIG. 10 discloses a structure in which the first flexible circuit board extends from the left control circuit board 42 to facilitate grounded connection and to improve the intensity of the signal.

Figure 11:
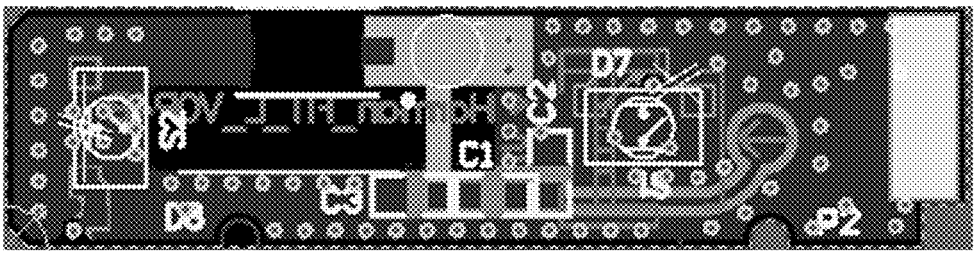
FIGS. 11 and 12 are another structural schematic view of a left control circuit board connected with a first flexible circuit board according to a first embodiment of the present application; among then, the FIG. 11 is a structure view of the left control circuit board, and the FIG. 12 is a structure view of the first flexible circuit board.
Figure 12:
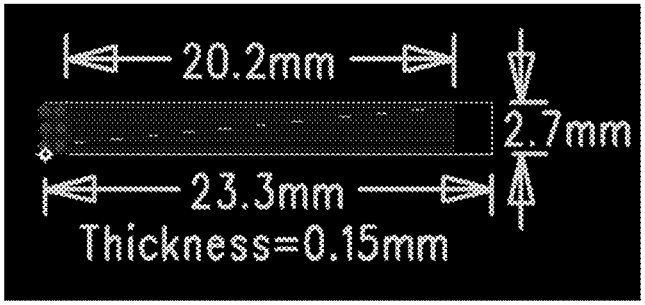

Further, please refer to FIG. 11 and FIG. 12, as a specific implementation manner of the Bluetooth earphone 100 provided by the present application, FIG. 11 discloses another structure of the left control circuit board 42; FIG. 12 discloses another structure of a first flexible circuit board, the first flexible circuit board is an FPC copper 45 structure. the FPC copper 45 can be connected to the ground layer of the left control board 42 when used.

Please refer to FIG. 12, the difference between the Bluetooth earphone 100 of the embodiment from the Bluetooth earphone of the first embodiment is that: in this embodiment, the cable antenna 30 is mounted on the left wire 13 to facilitate the device layout of the antenna. In other embodiments, the cable antenna 30 may also be mounted on the right wire 14. In still other embodiments, the cable antenna 30 may be mounted on both the left wire 13 and right wire 14.

The cable antenna 30 is mounted in at least one of the component: the left wire 13, the right wire 14 and the controller 20, which can facilitate the arrangement of the cable antenna and determine the size, length arrangement and position of the antenna, such that the stability and intensity of the signal transmitting is improved, and the signal intensity of the wireless communication of the Bluetooth earphone is improved, and the communication stability is ensured.

Due that the cable antenna 30 is used, it is convenient to bend the antenna to facilitate the mounting and layout of the antenna, such as fixing the cable antenna 30 on the left wire 13, or fixing the cable antenna 30 on the right wire 14. In addition, in some embodiments, it is also possible to provide the cable antenna 30 on both the left wire 13 and the right wire 14.

Further, as a specific implementation manner of the Bluetooth earphone 100 provided by the present application, the cable antenna 30 is electrically connected to the main control circuit board 22 by the corresponding end of the casing 21 extending into the casing 21. For example, when the cable antenna 30 is mounted on the left wire 13, the cable antenna 30 extends into the casing 21 from the left end of the casing 21, and then electrically connects to the main control circuit board 22, such that the cable antenna 30 can be better connected to the left wire 13 and remains in conformity with the shape of the left wire 13. Similarly, when the cable antenna 30 is mounted on the right wire 14, the cable antenna 30 extends into the casing 21 from the right end of the casing 21, and then electrically connects to the main control circuit board 22, such that the cable antenna 30 can better connected to the right wire 14 and remains in conformity with the shape of the right wire 14.

Further, as a specific implementation manner of the Bluetooth earphone 100 provided by the present application, the cable antenna 30 on the left wire 13 is spaced apart from the left wire 13 or/and the cable antenna 30 on the right wire 14 is spaced apart from the right wire 14. That is, when the cable antenna 30 is mounted on the left wire 13, the cable antenna 30 is spaced apart from the left wire 13 to prevent the left wire 13 from affecting the signal transmitting and receiving of the cable antenna 30. When the cable antenna 30 is mounted on the right wire 14, the cable antenna 30 is spaced apart from the right wire 14 to prevent the right wire 14 from affecting the signal transmitting and receiving of the cable antenna 30.

Figure 13:
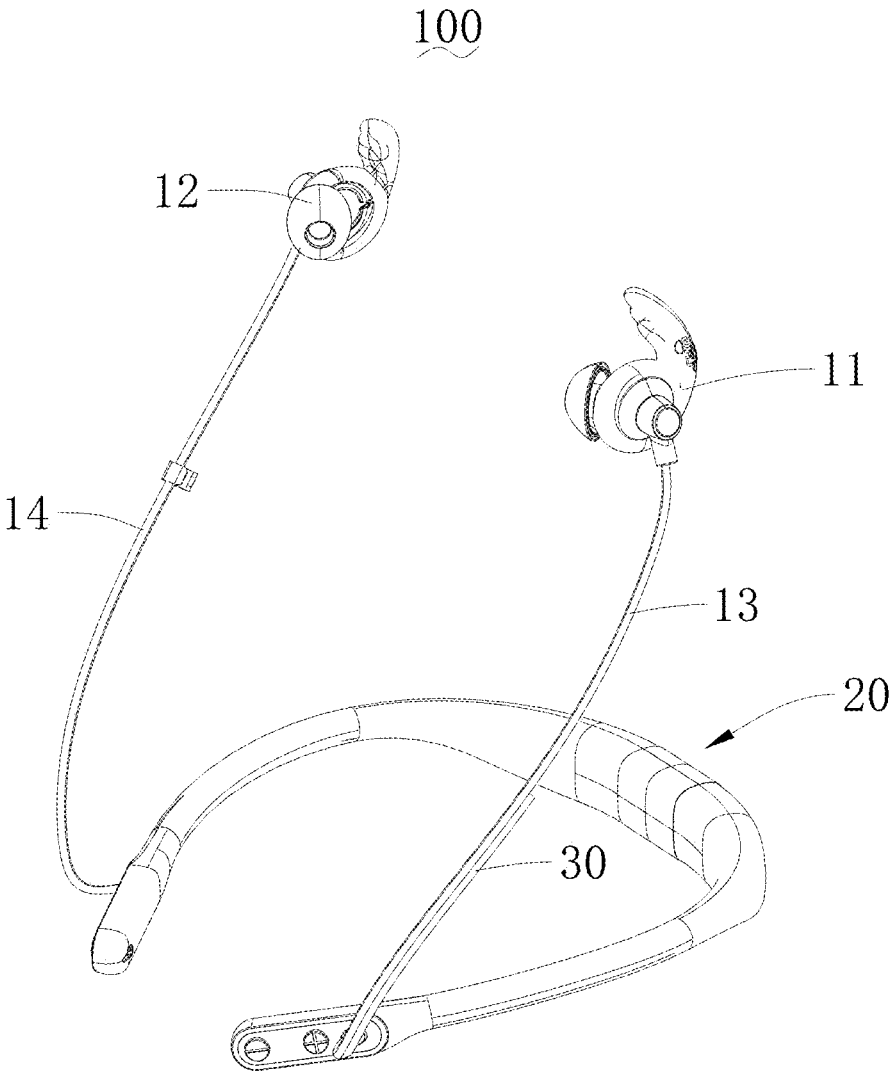
FIG. 13 is a structural schematic view of another cable antenna according to a second embodiment of the present application.

Further, please refer to FIG. 12 and FIG. 13, as an embodiment of the Bluetooth earphone 100 provided by the present application, the insulating sleeve 32 is provided with a conductive wire 35 configured for connecting the main control circuit board 22 and the sound generation unit. The conductive wire 35 is disposed in the insulating sleeve 32, the sound generation unit of the corresponding earphone and the main control circuit board 22 can be electrically connected at the same time when the cable antenna 30 is used, that is, the left wire 13 is integrated with the cable antenna 30, or the right wire 14 is integrated with the cable antenna 30, that is, the cable antenna 30 and the left wire 13 or the right wire 14 form a multi-core cable.

In the specific production, it is necessary to insulate the conductive wire 35 from the conductive inner core 31, such as using an enameled wire for both the conductive wire 35 and the conductive inner core 31, or using a wire structure with an insulating skin for the conductive wire 35. In addition, in still other embodiments, an insulating sleeve can be provided and the conductive wire and cable antenna 30 can be integrated into the insulating sleeve. In use, the conductive wire can be used both as the left wire 13 and as the right wire 14.

Other structures of the Bluetooth earphone 100 of the embodiment are the same as those of the Bluetooth earphone 100 of the first embodiment, and details are not described herein again.

The aforementioned embodiments are only preferred embodiments of the present application. For one of ordinary skill in the art, according to the thought of the present application, specific implementation modes and application scopes may be modified, and the content of the specification should not be interpreted as any limitation to the present application.

What is claimed is:

1. A Bluetooth sport earphone, comprising:

a left earphone and a right earphone, each provided with a sound generation unit;

a controller, configured to control the left earphone and the right earphone, the controller comprising a casing, a main control circuit board disposed in the casing, a battery mounted inside the casing and a Bluetooth module configured for wireless communication; the battery and the Bluetooth module being respectively electrically connected to the main control circuit board, the Bluetooth sport earphone further comprising:

a left wire, configured to electrically connect the left earphone to the main control circuit board; and a right wire, configured to electrically connect the right earphone to the main control circuit board;

wherein the Bluetooth sport earphone further comprises a cable antenna electrically connected with the main control circuit board, and at least one of the casing, the left wire, and the right wire is mounted with the cable antenna;

wherein the cable antenna comprises: a conductive inner core; a conductive outer layer; and an insulating layer, disposed between the conductive inner core and the conductive outer layer; the conductive inner core is electrically connected to the main control circuit board; and wherein an end of the cable antenna is provided with a signal transmitting and receiving end; the signal transmitting and receiving end comprises: a conductive segment and an insulating segment wherein the conductive segment is a segment of the conductive inner core extending out of an end of the conductive outer layer, and the insulating segment is a segment of the insulating layer extending out of an end of the conductive outer layer; wherein a length of the signal transmitting and receiving end is one quarter of a wavelength of a transmitted and received signal.

2. The Bluetooth sport earphone of claim 1, wherein the conductive outer layer is a shielding layer sleeved on the insulating layer.

3. The Bluetooth sport earphone of claim 1, wherein the cable antenna further comprises a protective outer layer sleeved on the conductive outer layer, and the conductive outer layer is disposed between the insulating layer and the protective outer layer.

4. The Bluetooth sport earphone of claim 1, wherein the casing is an unclosed elastic collar having two ends, and the main control circuit board, the battery and the Bluetooth module are disposed at the middle of the casing.

5. The Bluetooth sport earphone of claim 4, wherein the left wire and the right wire are respectively extended from the two ends of the casing.

6. The Bluetooth sport earphone of claim 5, wherein the cable antenna is electrically connected to the main control circuit board through a corresponding end of the casing extending into the casing.

7. The Bluetooth sport earphone of claim 6, wherein the cable antenna and the left wire or the right wire form a multi-core cable.

8. The Bluetooth sport earphone of claim 6, wherein the cable antenna on the left wire is spaced apart from the left wire, and/or the cable antenna on the right wire is spaced apart from the right wire.

9. The Bluetooth sport earphone of claim 4, wherein the casing comprises: a middle control box, a left arm and a right arm respectively extending from two ends of the middle control box, a left control box connected to a free end of the left arm, and a right control box connected to a free end of the right arm.

10. The Bluetooth sport earphone of claim 9, wherein the cable antenna is mounted inside the casing, and the cable antenna is extending in a direction away from the main circuit board to the left arm, the right arm, the left control box, or the right control box.

11. The Bluetooth sport earphone of claim 9, wherein a left control circuit board and the cable antenna are mounted inside the left control box, and the left control circuit board is electrically connected to the main control circuit board, the cable antenna is arranged around the left control circuit board and configured to be spaced apart from the left control circuit board.

12. The Bluetooth sport earphone of claim 11, wherein the left control circuit board is provided with a first antenna electrically connected with the cable antenna.

13. The Bluetooth sport earphone of claim 12, wherein the first antenna is a printed antenna or a ceramic antenna.

14. The Bluetooth sport earphone of claim 12, wherein a first flexible flat conductive wire is extended from the left control circuit board, and the first flexible flat conductive wire is provided with a conductive layer electrically connected with a ground layer of the left control circuit board.

15. The Bluetooth sport earphone of claim 9, wherein a right control circuit board and the cable antenna are mounted inside the right control box, and the right control circuit board is electrically connected to the main control circuit board, the cable antenna is arranged around the right control circuit board and configured to be spaced apart from the right control circuit board.

16. The Bluetooth sport earphone of claim 15, wherein the right control circuit board is provided with a second antenna electrically connected with the cable antenna.

17. The Bluetooth sport earphone of claim 16, wherein the second antenna is a printed antenna or a ceramic antenna.

18. The Bluetooth sport earphone of claim 17, wherein a second flexible flat conductive wire is extended from the right control circuit board, and the second flexible flat conductive wire is provided with a conductive layer electrically connected with a ground layer of the right control circuit board.

* * * * *